US011765801B2

(12) United States Patent
Hwang et al.

(10) Patent No.: US 11,765,801 B2
(45) Date of Patent: Sep. 19, 2023

(54) LED DRIVER, LIGHT-EMITTING MODULE, AND DISPLAY DEVICE FOR LOCAL DIMMING

(71) Applicant: WELLANG CO., LTD., Gyeonggi-do (KR)

(72) Inventors: Jong Tae Hwang, Seoul (KR); Sung Hun Cho, Gyeonggi-do (KR)

(73) Assignee: WELLANG CO., LTD., Gyeonggi-do (KR)

( * ) Notice: Subject to any disclaimer, the term of this patent is extended or adjusted under 35 U.S.C. 154(b) by 0 days.

(21) Appl. No.: 17/860,659

(22) Filed: Jul. 8, 2022

(65) Prior Publication Data

US 2023/0028188 A1 Jan. 26, 2023

(30) Foreign Application Priority Data

Jul. 23, 2021 (KR) ..... 10-2021-0097183

(51) Int. Cl.

| | |
|---|---|
| ***H05B 45/30*** | (2020.01) |
| ***H05B 45/44*** | (2020.01) |
| ***H05B 45/10*** | (2020.01) |
| ***G09F 9/33*** | (2006.01) |

(52) U.S. Cl.

CPC ..... *H05B 45/30* (2020.01); *G09F 9/33* (2013.01); *H05B 45/10* (2020.01); *H05B 45/44* (2020.01)

(58) Field of Classification Search

CPC ..... H05B 45/10; H05B 45/375; H01Q 1/242; H01Q 1/243; H01Q 1/38; H01Q 5/321

See application file for complete search history.

(56) References Cited

U.S. PATENT DOCUMENTS

| | | | | |
|---|---|---|---|---|
| 10,973,098 | B1 | 4/2021 | Chen et al. | |
| 2007/0083491 | A1* | 4/2007 | Walmsley | G06F 21/608 |
| 2009/0085500 | A1* | 4/2009 | Zampini, II | H05B 45/00 315/297 |

(Continued)

FOREIGN PATENT DOCUMENTS

| | | | |
|---|---|---|---|
| EP | 2043080 | A1 | 4/2009 |
| EP | 2299434 | A1 | 3/2011 |

(Continued)

OTHER PUBLICATIONS

Office Action issued in corresponding Korean Application No. 10-2021-0097183 dated Sep. 28, 2021, and English Translation, 10 pages.

(Continued)

*Primary Examiner* — Monica C King

(74) *Attorney, Agent, or Firm* — GUNTIN & GUST, PLC; Miyoung Shin

(57) ABSTRACT

A light-emitting diode (LED) driver configured to generate an LED driving current based on an input signal may include a terminal exposed to outside, a controller configured to identify a first identifier and data from the input signal, identify a second identifier based on a signal applied to the terminal, and when the first identifier and the second identifier are identical to each other, generate a control signal based on the data. The LED driver further may further include a current source configured to generate the LED driving current based on the control signal.

6 Claims, 10 Drawing Sheets

(56) References Cited

U.S. PATENT DOCUMENTS

| | | | | |
|---|---|---|---|---|
| 2012/0176064 | A1* | 7/2012 | Saes | H05B 45/3725 315/307 |
| 2016/0076751 | A1* | 3/2016 | Liang | F21V 23/005 362/427 |
| 2016/0285151 | A1* | 9/2016 | Lee | H01Q 1/242 |
| 2018/0160493 | A1* | 6/2018 | Picard | H05B 47/19 |
| 2019/0279484 | A1* | 9/2019 | Ke | G06F 11/328 |
| 2020/0312226 | A1 | 10/2020 | Hussell | |

FOREIGN PATENT DOCUMENTS

| | | | |
|---|---|---|---|
| KR | 1020110051398 | A | 5/2011 |
| KR | 1020150098031 | A | 8/2015 |
| KR | 1020170025110 | A | 3/2017 |

OTHER PUBLICATIONS

Notice of Allowance issued in corresponding Korean Application No. 10-2021-0097183 dated Feb. 9, 2022, and English Translation, 4 pages.

Extended European search report for Corresponding EP Application No. 22183684.4-1201, dated Dec. 16, 2022, 12 pgs.

* cited by examiner

LED DRIVER, LIGHT-EMITTING MODULE, AND DISPLAY DEVICE FOR LOCAL DIMMING

CROSS-REFERENCE TO RELATED APPLICATION

This application is based on and claims priority under 35 U.S.C. § 119 to Korean Patent Application No. 10-2021-0097183, filed on Jul. 23, 2021, in the Korean Intellectual Property Office, the disclosure of which is incorporated by reference herein in its entirety.

BACKGROUND

1. Field

The one or more embodiments relate to light-emitting diode (LED) driving, and more particularly, to an LED driver, a light-emitting module, and a display device, each for local dimming.

2. Description of the Related Art

Light-emitting diodes (LEDs) are used in various applications due to their advantages such as low power consumption, small size, and the like. For example, LEDs may be used as a backlight of a display. As an example of using LEDs as a backlight, a mini LED may refer to a method of densely arranging small-sized (for example, several hundred μm) LEDs and controlling the brightness of the LEDs according to display content. Such local dimming may achieve a fine contrast ratio as the density of LEDs increases, that is, as the number of local dimming zones increases. Accordingly, it may be important to precisely determine the arrangement of a plurality of LEDs in the mini LED.

SUMMARY

The present disclosure provides a light-emitting diode (LED) driver, a light-emitting module, and a display device for efficiently performing local dimming.

Additional aspects will be set forth in part in the description which follows and, in part, will be apparent from the description, or may be learned by practice of the presented embodiments of the disclosure.

According to an aspect of the inventive concept, an LED driver that generates an LED driving current based on an input signal may include a terminal exposed to outside, a controller that identifies a first identifier and data from the input signal, identifies a second identifier based on a signal applied to the terminal, and when the first identifier and the second identifier are identical to each other, generates a control signal based on the data, and a current source that generates the LED driving current based on the control signal.

According to an example embodiment, the first identifier may include a first column address and a first row address, and the controller may extract, from the input signal, a first packet including the first column address and the data and a second packet including the first row address.

According to an example embodiment, the second identifier may include a second column address and a second row address, and the controller may latch the data in a case where the first column address and the second column address are identical to each other when receiving the first packet, and may generate the control signal based on the latched data in a case where the first row address and the second row address are identical to each other when receiving the second packet.

According to an example embodiment, the controller may extract a third packet including a command and a parameter from the input signal, and may generate the control signal based on the command and the parameter.

According to an example embodiment, the LED driver may further include a repeater that generates an output signal by amplifying the input signal and output the output signal to the outside of the LED driver.

According to an example embodiment, the repeater may receive an enable signal from the outside of the LED driver, and when the enable signal is deactivated, block power consumption.

According to an aspect of the inventive concept, a light-emitting module may include an LED array including a plurality of LEDs, an LED driver array including a plurality of LED drivers that respectively generate a plurality of LED driving currents respectively corresponding to the plurality of LEDs based on an input signal, and a board on which the LED array and the LED driver array are mounted, wherein the board may include a plurality of first patterns connected to two adjacent LED drivers such that LED drivers included in each row of the LED driver array receive the input signal in a chain, and a plurality of second patterns respectively connected to the plurality of LED drivers such that a unique signal is applied to each of the plurality of LED drivers.

According to an example embodiment, the plurality of second patterns may include a second pattern configured to apply a common signal to LED drivers included in each row of the LED driver array, and a second pattern configured to apply a common signal to LED drivers included in each column of the LED driver array.

According to an example embodiment, at least one of a constant voltage, a constant current, and a constant resistance may be applied to each of the plurality of second patterns.

According to an example embodiment, the board may further include a plurality of third patterns connected to two adjacent LED drivers such that LED drivers included in a first column among columns of the LED driver array receive the input signal in a chain.

According to an example embodiment, the board may further include at least one fourth pattern commonly connected to LED drivers included in a first column such that the LED drivers included in the first column among columns of the LED driver array commonly receive the input signal.

According to an example embodiment, the board may further include at least one fifth pattern connected to each of a plurality of end LED drivers such that a deactivated enable signal is applied to a end LED driver that finally receives the input signal in each row of the LED driver array, and at least one sixth pattern connected to each of other LED drivers except for the plurality of end LED drivers such that an activated enable signal is applied to the other LED drivers except for the end LED driver in each row of the LED driver array.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
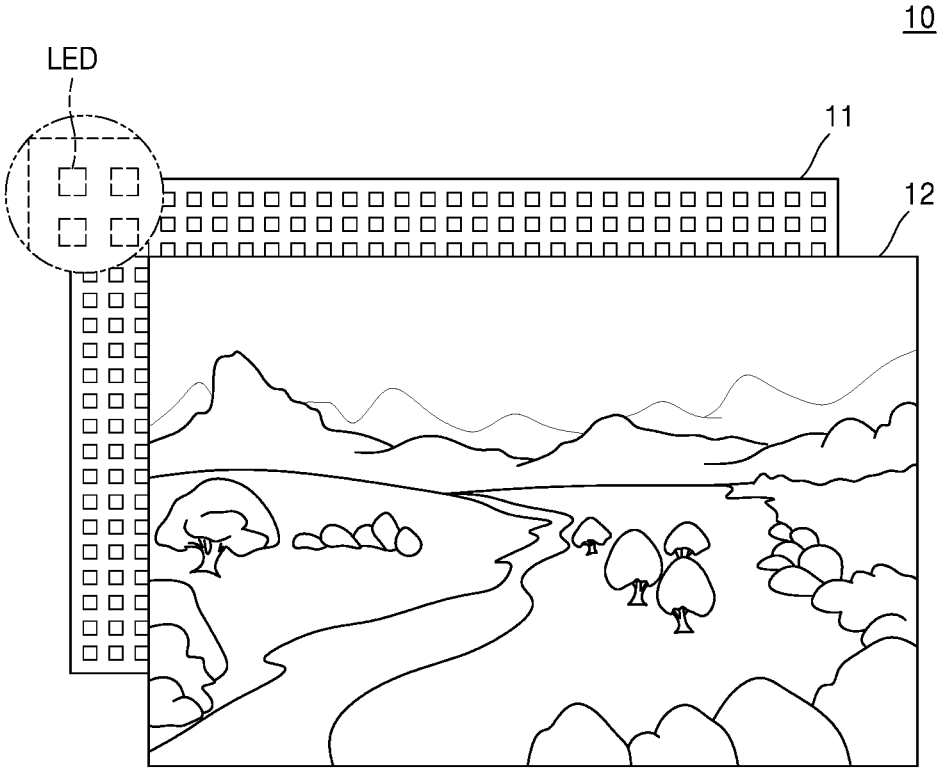
FIG. 1 is a diagram of a display device according to an example embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Hereinafter, embodiments will be described in detail with reference to the accompanying drawings. These embodiments are provided so that this disclosure will be thorough and complete, and will fully convey the concept of the inventive concept to those of ordinary skill in the art. As the inventive concept allows for various changes and numerous embodiments, particular embodiments will be illustrated in the drawings and described in detail in the written description. However, this is not intended to limit the inventive concept to particular modes of practice, and it is to be appreciated that all changes, equivalents, and substitutes that do not depart from the spirit and technical scope are encompassed in the inventive concept. Like reference numerals in the drawings denote like elements. In the accompanying drawings, dimensions of structures may be exaggerated for clarity of the inventive concept.

The terms used in the present specification are merely used to describe particular embodiments, and are not intended to limit the inventive concept. An expression used in the singular encompasses the expression of the plural, unless it has a clearly different meaning in the context. In the present specification, it is to be understood that the terms such as "including," "having," and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Unless defined differently, all terms used herein, which include technical terms or scientific terms, have the same meaning as that understood by those of ordinary skill in the art. Such terms as those defined in a generally used dictionary are to be interpreted to have the meanings equal to the contextual meanings in the relevant field of art, and are not to be interpreted to have ideal or excessively formal meanings unless clearly defined in the present specification.

FIG. 1 is a diagram of a display device 10 according to an example embodiment. Specifically, FIG. 1 shows a backlight unit (BLU) 11 and a color panel 12 included in a display panel of the display device 10 separately for convenience of illustration.

The display device 10 may refer to any device that outputs content, that is, an image or a movie, through the display panel. For example, the display device 10 may be an independent device for display purposes, such as a television (TV) or a monitor, or may be included in a system, such as a display of a smart phone or a cluster of a vehicle, for a function requiring a display. The display device 10 may output content in any manner using the BLU 11. For example, the BLU 11 and the color panel 12 may be included in a liquid crystal display (LCD) panel, and the color panel 12 may include a polarizer, a thin-film transistor (TFT), a liquid crystal, a color filter, and the like. Hereinafter, it is assumed that the display device 10 includes an LCD panel, but it is noted that example embodiments are not limited thereto.

The BLU 11 may include a plurality of light-emitting diodes (LEDs) as a light source. For example, as shown in FIG. 1, the BLU 11 may include a plurality of LEDs arranged in the form of an array. Light output from the LEDs of the BLU 11 may be combined into a color corresponding to content by the color panel 12 and then output. A mini LED may refer to a method of densely arranging small-sized (for example, several hundred μm) LEDs of the BLU 11 and controlling the brightness of a local dimming zone consisting of at least one LED, that is, the intensity of light output from the local dimming zone, according to content. Such a mini LED may resolve a low contrast ratio of an LCD display, thereby enabling a high-quality low-cost display device.

As the density of local dimming zones included in the BLU 11 increases, more precise local dimming may be possible, and as a result, a high contrast ratio may be achieved. Accordingly, in addition to precisely controlling a plurality of local dimming zones included in the BLU 11, it may be important to rapidly control the local dimming zones to respond to rapid changes (that is, high frame rate) of content. Hereinafter, an LED driver, a light-emitting module, and a display device, each providing advantages to a mini LED, will be described with reference to the drawings.

Figure 2:
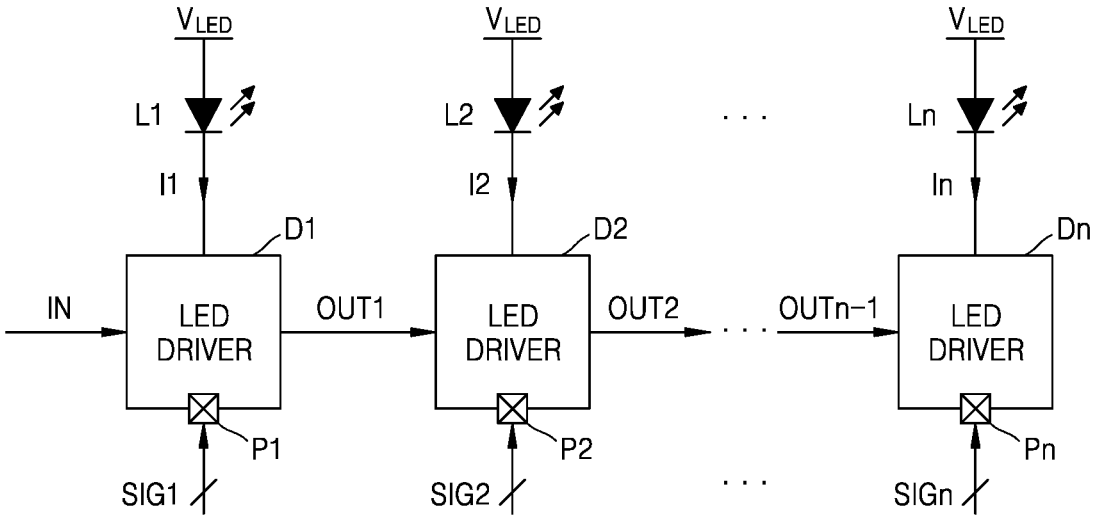
FIG. 2 is a block diagram of a light-emitting module according to an example embodiment.

FIG. 2 is a block diagram of a light-emitting module 20 according to an example embodiment. In some embodiments, the light-emitting module 20 may be included in the BLU 11 of FIG. 1. As described above with reference to FIG. 1, the BLU 11 may include at least one light-emitting module. As shown in FIG. 2, the light-emitting module 20 may include first to $n^{th}$ LEDs L1 to Ln and first to $n^{th}$ LED drivers D1 to Dn (wherein n is an integer greater than 1). Herein, one LED driver is shown and described as driving one LED, that is, a local dimming zone including one LED, but in some embodiments, an LED driver may drive two or more LEDs connected in series and/or parallel to each other. In other words, LEDs shown in the drawings may include one LED device, or may include two or more LED devices connected in series and/or parallel to each other.

Referring to FIG. 2, the first to $n^{th}$ LED drivers D1 to Dn may respectively drive the first to $n^{th}$ LEDs L1 to Ln. For example, as shown in FIG. 2, the first LED driver D1 may drain a first LED driving current I1 from the first LED L1, the second LED driver D2 may drain a second LED driving current I2 from the second LED L2, and the $n^{th}$ LED driver Dn may drain an $n^{th}$ LED driving current In from the $n^{th}$ LED Ln. A positive voltage $V_{LED}$ may be applied to anodes of the first to $n^{th}$ LEDs L1 to Ln, and the intensity of light output from the first to $n^{th}$ LEDs L1 to Ln may be controlled according to the magnitude of first to $n^{th}$ LED driving currents I1 to In.

In some embodiments, LED drivers may have the same structure, and may be connected to each other to receive an input signal IN in a chain. The input signal IN may include information for controlling the first to $n^{th}$ LED drivers D1 to Dn, as described below with reference to FIG. 5 and the like. The first LED driver D1 may receive the input signal IN, and may generate the first LED driving current I1 based on the information included in the input signal IN. Also, the first LED driver D1 may generate a first output signal OUT1 by amplifying the input signal IN, and thus, the first output signal OUT1 may include the same information as the input signal IN and may have desirable characteristics such as a low bit error rate (BER) and/or a high signal-to-noise ratio (SNR). The second LED driver D2 may receive the first output signal OUT1 from the first LED driver D1, and may generate the second LED driving current I2 based on the information included in the first output signal OUT1. The second LED driver D2 may generate a second output signal OUT2 by amplifying the first output signal OUT1. The $n^{th}$ LED driver Dn may receive an $(n-1)^{th}$ output signal OUTn−1, and may generate the $n^{th}$ LED driving current In based on information included in the $(n-1)^{th}$ output signal OUTn−1.

Unlike in FIG. 2, when the first to $n^{th}$ LED drivers D1 to Dn receive the input signal IN through a common signal path, an LED driver greatly spaced apart from a point to which the input signal IN is applied, for example, the $n^{th}$ LED driver Dn, may receive the input signal IN that is distorted due to a parasitic component (for example, parasitic resistance and/or capacitance) or noise in the signal path. However, as shown in FIG. 2, the first to $n^{th}$ LED drivers D1 to Dn may be connected in series, and an LED driver may amplify a signal received from an adjacent LED driver and provide the amplified signal to another adjacent LED driver, thereby eliminating problems (for example, malfunctions and/or delays) caused by a parasitic component or noise in the signal path.

In some embodiments, an LED driver may identify information corresponding to itself from the input signal IN based on a signal received through a terminal exposed to outside. For example, as shown in FIG. 2, the first LED driver D1 may include a first terminal P1, and may receive a first signal SIG1 through the first terminal P1. In some embodiments, the first signal SIG1 may be a multi-bit, multi-level, or multi-bit-multi-level signal, and may have a value defined by a signal applied through a pattern of a board on which the first LED driver D1 is mounted. The first LED driver D1 may identify its identifier (herein, which may be referred to as a second identifier) based on the first signal SIG1, and may extract information corresponding to its identifier from the input signal IN. Similarly, the second LED driver D2 may include a second terminal P2 for receiving a second signal SIG2, and the $n^{th}$ LED driver Dn may include an $n^{th}$ terminal Pn for receiving an $n^{th}$ signal SIGn. First to $n^{th}$ signals SIG1 to SIGn may be different from each other, and thus, each of the first to $n^{th}$ LED drivers D1 to Dn may receive a unique signal and may have a unique identifier. In some embodiments, a terminal may include at least one pin exposed to outside. Accordingly, random access to each of the first to $n^{th}$ LED drivers D1 to Dn may be possible, and as a result, latency for controlling an LED may be reduced. Also, the first to $n^{th}$ LED drivers D1 to Dn may have the same structure regardless of an identifier, and thus, overhead for addressing an LED driver may be omitted, and the productivity of an LED driver, a light-emitting module including the LED driver, and a display device including the LED driver may be improved.

Figure 3:
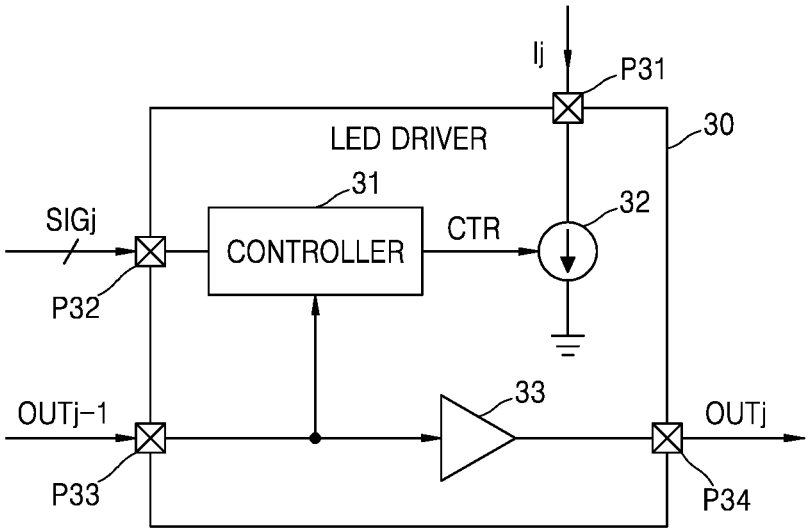
FIG. 3 is a block diagram of a light-emitting diode (LED) driver according to an example embodiment.

FIG. 3 is a block diagram of an LED driver 30 according to an example embodiment. As shown in FIG. 3, the LED driver 30 may include a controller 31, a current source 32, and a repeater 33, and may include first to fourth terminals P31 to P34.

The controller 31 may identify an identifier (that is, a second address) of the LED driver 30 based on a $j^{th}$ signal SIGj received through the second terminal P32 ($1 \le j \le n$). In some embodiments, the $j^{th}$ signal SIGj may be a multi-bit, multi-level, or multi-bit-multi-level signal, and the second terminal P32 may include a plurality of pins respectively corresponding to bits of the multi-bit signal. For example, the controller 31 may receive an 8-bit $j^{th}$ signal SIGj through eight pins, and may identify an 8-bit identifier.

The controller 31 may receive a $(j-1)^{th}$ output signal OUTj−1 through the third terminal P33. As described above with reference to FIG. 2, the $(j-1)^{th}$ output signal OUTj−1 may be provided from another LED driver adjacent to the LED driver 30. In some embodiments, like the first LED driver D1 in FIG. 2, the LED driver 30 may receive the input signal IN through the third terminal P33 (j=1). The controller 31 may identify an identifier (herein, which may be referred to as a first identifier) and data from the $(j-1)^{th}$ output signal OUTj−1. The controller 31 may generate a control signal CTR based on the data identified from the $(j-1)^{th}$ output signal OUTj−1. In some embodiments, the data may have a value indicating the magnitude of a $j^{th}$ LED driving current Ij, and the controller 31 may generate the control signal CTR so that the $j^{th}$ LED driving current Ij having the magnitude indicated by the value of the data is generated. An example of an operation of the controller 31 will be described with reference to FIG. 4.

The controller 31 may have any structure that performs the operation. For example, the controller 31 may include a programmable component such as a central processing unit (CPU) and a microcontroller, a reconfigurable component such as a field programmable logic array (FPGA), and/or a component that provides a fixed function such as an intellectual property (IP) core.

The current source 32 may receive the control signal CTR from the controller 31, and may generate the $j^{th}$ LED driving current Ij based on the control signal CTR. For example, as shown in FIG. 3, the current source 32 may drain the $j^{th}$ LED driving current Ij from the first terminal P31. The current source 32 may have any structure that generates the $j^{th}$ LED driving current Ij. For example, the control signal CTR may be a digital signal, and the current source 32 may generate the $j^{th}$ LED driving current Ij proportional to the magnitude of an analog signal generated by converting the control signal CTR. The current source 32 may generate a pulse width modulation (PWM) signal based on the control signal CTR, and may generate the $j^{th}$ LED driving current Ij proportional to the pulse width of the PWM signal.

The repeater 33 may receive the $(j-1)^{th}$ output signal OUTj−1 through the third terminal P33, and may output a $j^{th}$ output signal OUTj through the fourth terminal P34. The repeater 33 may amplify the $(j-1)^{th}$ output signal OUTj−1. For example, the repeater 33 may include a buffer, and the buffer may amplify the level of the $(j-1)^{th}$ output signal OUTj−1 to a positive power supply voltage VDD or a ground potential GND. Accordingly, the $j^{th}$ output signal OUTj may have a high SNR, and may be provided to another LED driver adjacent to the LED driver 30.

Figure 4:
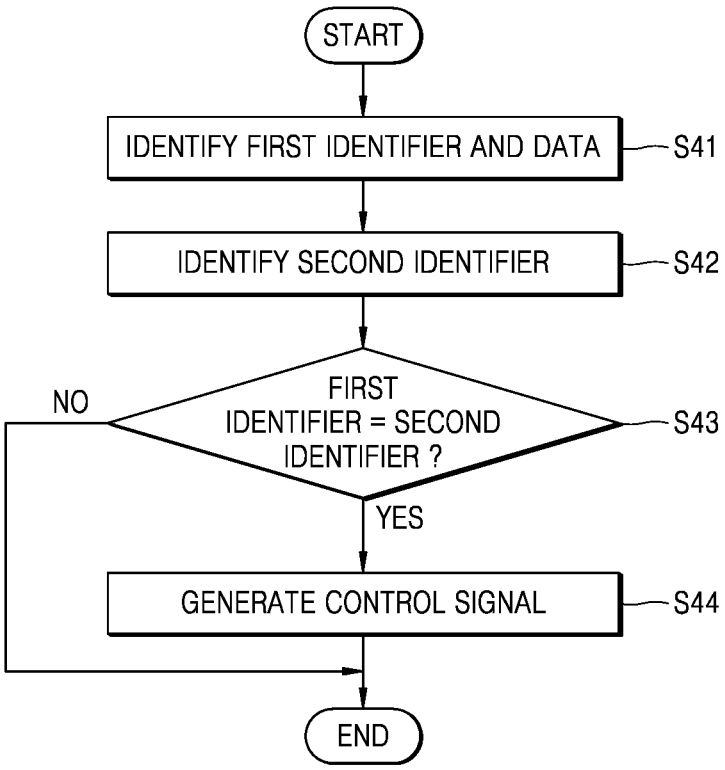
FIG. 4 is a flowchart of a method for local dimming according to an example embodiment.

FIG. 4 is a flowchart of a method for local dimming according to an example embodiment. As shown in FIG. 4, the method for local dimming may include a plurality of operations S41 to S44. In some embodiments, the method in FIG. 4 may be performed by the controller 31 in FIG. 3, and hereinafter, FIG. 4 will be described with reference to FIG. 3.

Referring to FIG. 4, the first identifier and the data may be identified in operation S41. For example, the controller 31 may identify an identifier, that is, the first identifier, from the $(j-1)^{th}$ output signal OUTj−1. As described below with reference to FIG. 5, the $(j-1)^{th}$ output signal OUTj−1 including the same information as the input signal IN in FIG. 2 may include a packet predefined according to a protocol. The controller 31 may extract at least one packet from the $(j-1)^{th}$ output signal OUTj−1, and may identify the first identifier and the data from the at least one extracted packet.

In operation S42, the second identifier may be identified. For example, the controller 31 may identify an identifier, that is, the second identifier, from the $j^{th}$ signal SIGj. As described above with reference to FIGS. 2 and 3, the $j^{th}$ signal SIGj may be a unique signal to the LED driver 30, and thus, the second identifier may be its unique identifier to the LED driver 30. The second identifier and the first identifier that is identified in operation S41 may have the same format (for example, the number of bits). In some embodiments, operation S41 and operation S42 may be performed in an order different from that shown in FIG. 4, or may be performed in parallel with each other.

In operation S43, the first identifier and the second identifier may be compared with each other. For example, the controller 31 may compare the first identifier identified in operation S41 with the second identifier identified in operation S42. As shown in FIG. 4, when the first identifier and the second identifier are identical to each other, operation S44 may be performed subsequently, whereas when the first identifier and the second identifier are different from each other, the method in FIG. 4 may end.

In operation S44, the control signal CTR may be generated. For example, when the first identifier and the second identifier are identical to each other, the controller 31 may determine that the data identified together with the first identifier in operation S41 is the data provided to the controller 31, and thus, may generate the control signal CTR based on the data identified in operation S41. As described above with reference to FIG. 3, the data may include a value indicating the magnitude of the $j^{th}$ LED driving current Ij, that is, dimming information, and the controller 31 may generate the control signal CTR so that the $j^{th}$ LED driving current Ij having the magnitude corresponding to the value of the data is generated, and then, provide the control signal CTR to the current source 32.

Figure 5:
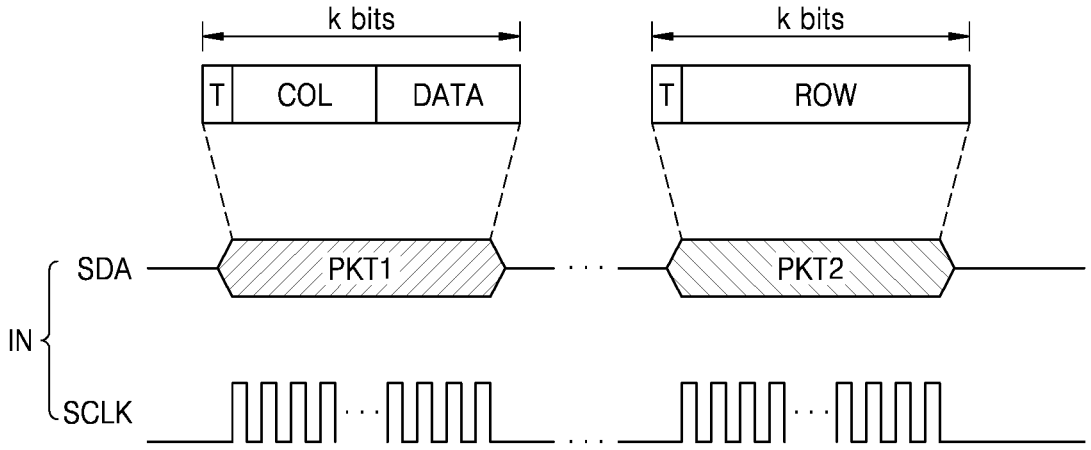
FIG. 5 is a timing diagram of an input signal according to an example embodiment.

FIG. 5 is a timing diagram of the input signal IN according to an example embodiment. As shown in FIG. 5, the input signal IN may include a data signal SDA and a clock signal SCLK. As described above, an output signal that an LED driver provides to an adjacent LED driver may also have the same format as the input signal IN in FIG. 5. Hereinafter, FIG. 5 will be described with reference to FIG. 3.

In some embodiments, the input signal IN may be based on a serial communication protocol. For example, as shown in FIG. 5, while the clock signal SCLK oscillates, a packet may be transmitted through the data signal SDA. For example, when an edge (a rising edge or a falling edge) of the clock signal SCLK is detected, the controller 31 may sample the data signal SDA, and may identify k values (wherein k is an integer greater than 1), which are consecutively sampled, as one packet.

In some embodiments, a packet may have various types. For example, as shown in FIG. 5, a first packet PKT1 may include a type field T, a column address field COL, and a data field DATA, whereas a second packet PKT2 may include a type field T and a row address field ROW. The type field T may have a value indicating a type of a packet, and thus, a value of the type field T included in the first packet PKT1 may be different from a value of the type field T included in the second packet PKT2. The controller 31 may identify a type of a packet based on a value of the type field T, and may decode the packet according to the identified type. In some embodiments, the fields may be arranged in an order different from that shown in FIG. 5.

A value of the column address field COL may indicate a column address of an LED driver, and a value of the row address field ROW may have a row address of the LED driver. As described above with reference to FIG. 1, the plurality of LEDs in the BLU 11 may be arranged in the form of an array, and thus, an LED driver may be addressed with a column address and a row address. Accordingly, the first identifier of the LED driver may include a column address (herein, which may be referred to as a first column address) indicated by a value of the column address field COL, and a row address (herein, which may be referred to as a first row address) indicated by a value of the row address field ROW. The second identifier of the LED driver may also include a column address (herein, which may be referred to as a second column address) and a row address (herein, which may be referred to as a second row address). In other words, when the $j^{th}$ signal SIGj is a multi-bit signal, the $j^{th}$ signal SIGj may include at least one bit indicating the second column address and at least one bit indicating the second row address. Rows and columns of an LED driver array may respectively correspond to rows and columns of a pixel array of the display device 10 (or the color panel 12) in some embodiments, and may respectively correspond to columns and rows of the pixel array of the display device 10 (or the color panel 12) in some embodiments.

As shown in FIG. 5, when the identifier includes the column address and the row address and the column address and the row address are received by different packets, the controller 31 may generate the control signal CTR based on data after receiving at least two packets. Hereinafter, with reference to FIG. 6, an example of an operation of the controller 31 that generates the control signal CTR based on the first packet PKT1 and the second packet PKT2 will be described.

Figure 6:
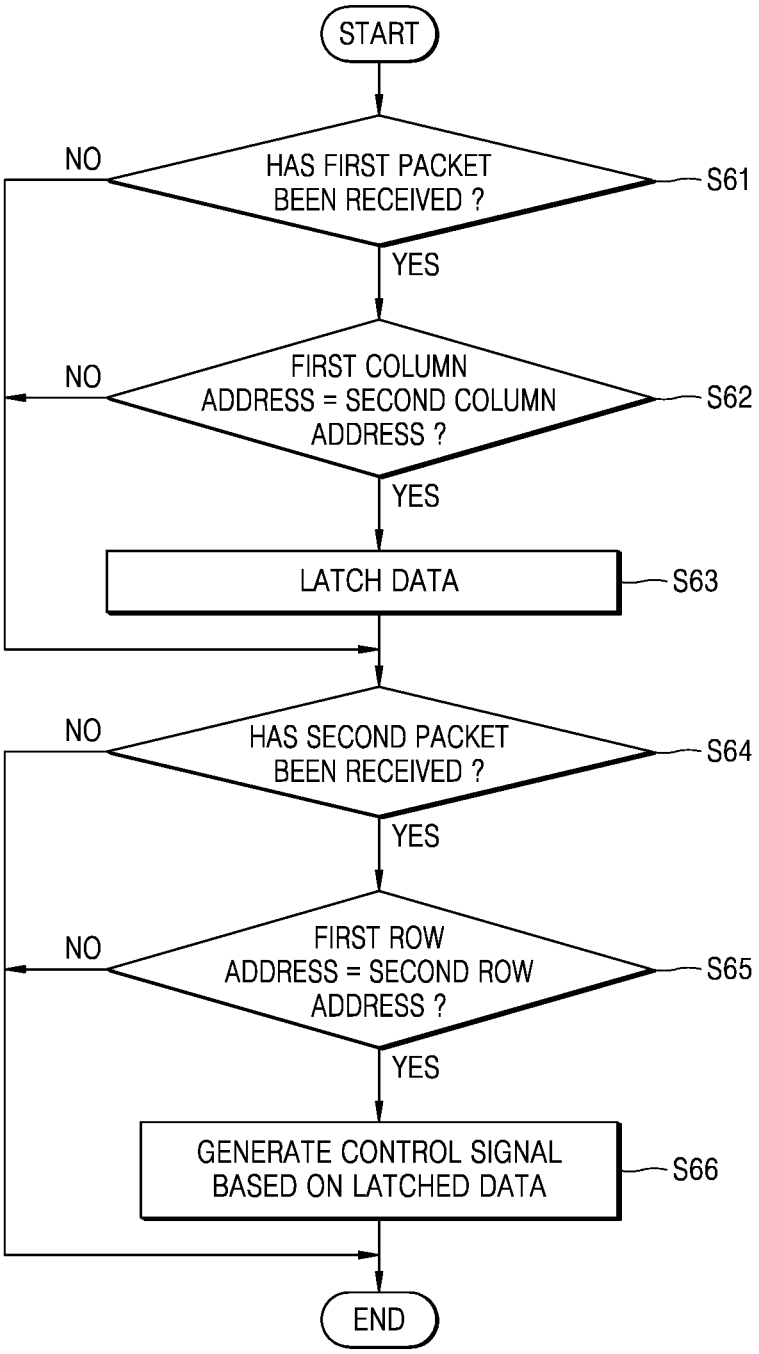
FIG. 6 is a flowchart of a method for local dimming according to an example embodiment.

FIG. 6 is a flowchart of a method for local dimming according to an example embodiment. Specifically, the flowchart in FIG. 6 shows an example of an operation of an LED driver when a packet is received. As shown in FIG. 6, the method for local dimming may include a plurality of operations S61 to S66. In some embodiments, the method in FIG. 6 may be performed by the controller 31 in FIG. 3, and hereinafter, FIG. 6 will be described with reference to FIGS. 3 and 5.

Referring to FIG. 6, whether the first packet PKT1 is received may be determined in operation S61. For example, when a packet is received through the $(j-1)^{th}$ output signal OUTj−1, the controller 31 may extract a value of the type field T included in the packet, and may identify a type of the packet based on the extracted value. As shown in FIG. 6, when the received packet is the first packet PKT1, operation S62 may be performed subsequently, whereas when the received packet is not the first packet PKT1, operation S64 may be performed subsequently.

When the received packet is the first packet PKT1, the first column address and the second column address may be compared with each other in operation S62. As described above with reference to FIG. 5, the first column address may be a value of the column address field COL included in the first packet PKT1, and the second column address may be a value included in the $j^{th}$ signal SIGj. As shown in FIG. 6, when the first column address and the second column address are identical to each other, operation S63 may be performed subsequently, whereas when the first column address and the second column address are different from each other, operation S64 may be performed subsequently.

When the first column address and the second column address are identical to each other, data may be latched in operation S63. For example, as described above with reference to FIG. 5, the first packet PKT1 may include the column address field COL and the data field DATA, and when a value of the column address field COL, that is, the first column address, matches the second column address, a value of the data field DATA, that is, data, may be latched. In some embodiments, the controller 31 may include a data storage device such as a register or a flip-flop, and the data storage device may store data included in the first packet PKT1.

In operation S64, whether the second packet PKT2 is received may be determined. For example, when a packet is received through the $(j-1)^{th}$ output signal OUTj−1, the controller 31 may extract a value of the type field T included in the packet, and may identify a type of the packet based on the extracted value. As shown in FIG. 6, when the received packet is the second packet PKT2, operation S65 may be performed, whereas when the received packet is not the second packet PKT2, the method in FIG. 6 may end.

When the received packet is the second packet PKT2, the first row address and the second row address may be compared with each other in operation S65. As described above with reference to FIG. 5, the first row address may be a value of the row address field ROW of the second packet PKT2, and the second row address may be a value included in the $j^{th}$ signal SIGj. As shown in FIG. 6, when the first row address and the second row address are identical to each other, operation S66 may be performed subsequently, whereas when the first row address and the second row address are different from each other, the method in FIG. 6 may end.

When the first row address and the second row address are identical to each other, the control signal CTR may be generated based on the latched data in operation S66. For example, when the first row address and the second row address are identical to each other, the controller 31 may determine that the first identifier and the second identifier are identical to each other, and may determine that the data latched in operation S63 is valid. Accordingly, the controller 31 may generate the control signal CTR based on the latched data, and as a result, an LED connected to the LED driver 30 may output light having an intensity corresponding to a value of the data.

Figure 7:
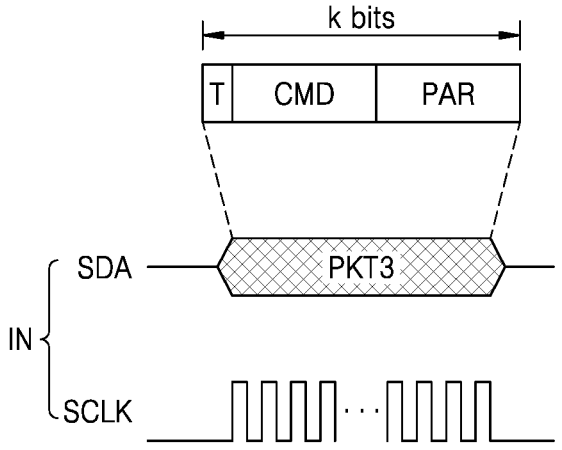
FIG. 7 is a timing diagram of an input signal according to an example embodiment.

FIG. 7 is a timing diagram of the input signal IN according to an example embodiment. As shown in FIG. 7, the input signal IN may include a data signal SDA and a clock signal SCLK. As described above, an output signal that an LED driver provides to an adjacent LED driver may also have the same format as the input signal IN in FIG. 7. Hereinafter, repeated descriptions of FIG. 5 in descriptions of FIG. 7 will be omitted, and FIG. 7 will be described with reference to FIG. 3.

In some embodiments, the input signal IN may support a packet that provides information to all LED drivers. For example, as shown in FIG. 7, a third packet PKT3 may include a type field T, a command field CMD, and a parameter field PAR. The controller 31 may identify the third packet PKT3 based on a value of the type field T, and may extract a value of the command field CMD and a value of the parameter field PAR from the third packet PKT3.

The command field CMD may have a value corresponding to one of a plurality of predefined commands. For example, the plurality of commands may include a first command to instruct turning off of an LED (that is, zero LED driving current), a second command to instruct a maximum brightness of the LED (that is, a maximum value of the LED driving current), a third command to instruct a constant brightness of the LED, a fourth command to instruct controlling of the brightness of the LED according to a pattern predefined for testing, and the like. The parameter field PAR may have a value corresponding to a parameter of a command indicated by the value of the command field CMD. For example, when the value of the command field CMD indicates the third command, the parameter field PAR may have a value corresponding to the brightness of the LED. In some embodiments, the command field CMD may include a column address or a row address, and the parameter field PAR may have a value corresponding to the brightness of the LED. Accordingly, a plurality of LEDs corresponding to the column address or the row address indicated by the command field CMD may be simultaneously controlled to a brightness corresponding to the value of the parameter field PAR. An example of an operation of the controller 31 when the third packet PKT3 is received will be described with reference to FIG. 8.

Figure 8:
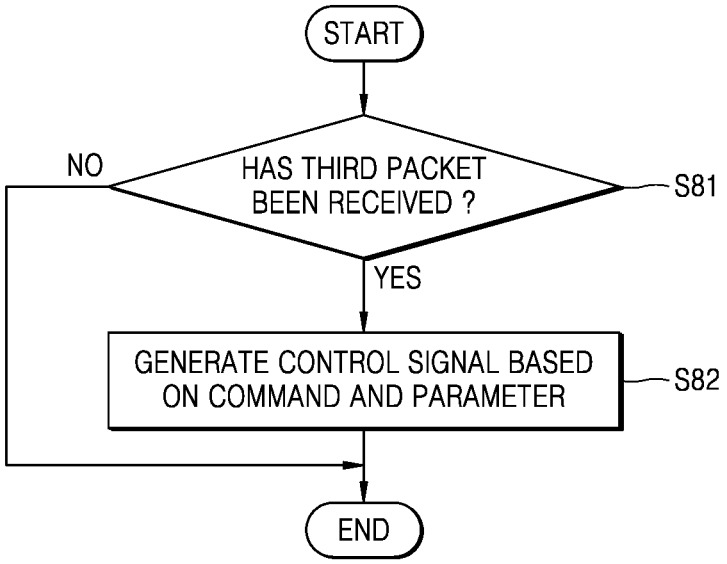
FIG. 8 is a flowchart of a method for local dimming according to an example embodiment.

FIG. 8 is a flowchart of a method for local dimming according to an example embodiment. Specifically, the flowchart in FIG. 8 shows an example of an operation of an LED driver when a packet is received. As shown in FIG. 8, the method for local dimming may include operation S81 and operation S82. In some embodiments, the method in FIG. 8 may be performed by the controller 31 in FIG. 3, and hereinafter, FIG. 8 will be described with reference to FIGS. 3 and 7.

Referring to FIG. 8, whether the third packet PKT3 is received may be determined in operation S81. For example, when a packet is received through the (j−1)th output signal OUTj−1, the controller 31 may extract a value of the type field T included in the packet, and may identify a type of the packet based on the extracted value. As shown in FIG. 8, when the received packet is the third packet PKT3, operation S82 may be performed subsequently, whereas when the received packet is not the third packet PKT3, the method in FIG. 8 may end.

When the received packet is the third packet PKT3, a control signal may be generated based on a command and a parameter in operation S82. As described above with reference to FIG. 7, the command may be a value of the command field CMD included in the third packet PKT3, and the parameter may be a value of the parameter field PAR included in the third packet PKT3. The controller 31 may identify the command based on the value of the command field CMD, and may interpret the value of the parameter field PAR based on the identified command. Accordingly, the controller 31 may perform an operation indicated by the command, that is, generation of the control signal, according to a value of the parameter.

Figure 9:
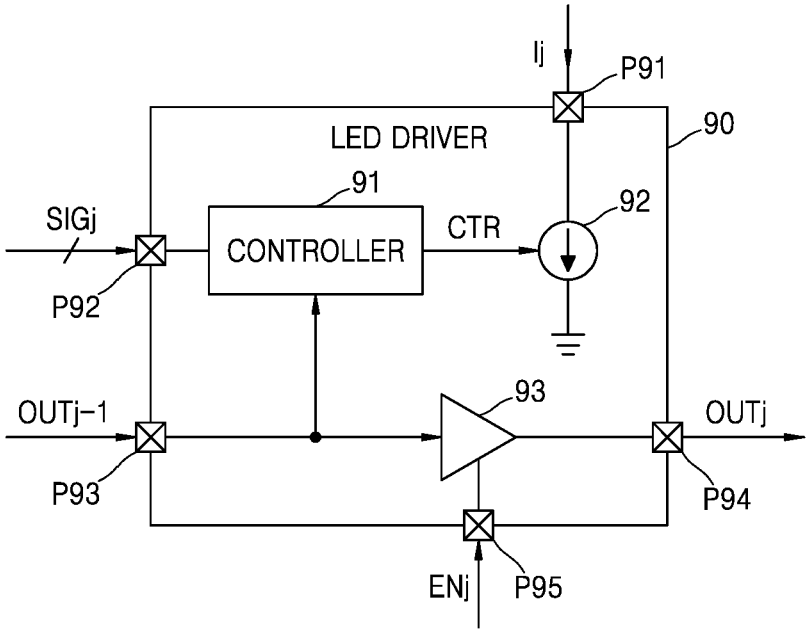
FIG. 9 is a block diagram of an LED driver according to an example embodiment.

FIG. 9 is a block diagram of an LED driver 90 according to an example embodiment. As shown in FIG. 9, the LED driver 90 may include a controller 91, a current source 92, and a repeater 93, and may include first to fifth terminals P91 to P95. Hereinafter, repeated descriptions of FIG. 3 in descriptions of FIG. 9 will be omitted.

When compared with the LED driver 30 in FIG. 3, the LED driver 90 in FIG. 9 may further receive a $j^{th}$ enable signal ENj through the fifth terminal P95. As shown in FIG. 9, the $j^{th}$ enable signal ENj may be provided to the repeater 93 through the fifth terminal P95. The repeater 93 may be enabled or disabled according to the $j^{th}$ enable signal ENj. For example, when receiving an activated (high-level or low-level) $j^{th}$ enable signal ENj, the repeater 93 may be enabled, and may generate the $j^{th}$ output signal OUTj by amplifying the $(j-1)^{th}$ output signal OUTj−1. In some embodiments, when receiving a deactivated (low-level or high-level) $j^{th}$ enable signal ENj, the repeater 93 may be disabled, and may not perform amplification of the $(j-1)^{th}$ output signal OUTj−1. In some embodiments, the repeater 93 may block the positive power supply voltage VDD and/or the ground potential GND provided to the buffer included in the repeater 93 in response to the deactivated $j^{th}$ enable signal ENj, and accordingly, may block power consumption. Accordingly, like the $n^{th}$ LED driver Dn in FIG. 2, in an LED driver in which a repeater is not used, unnecessary power consumption by the repeater may be eliminated.

Figure 10A:
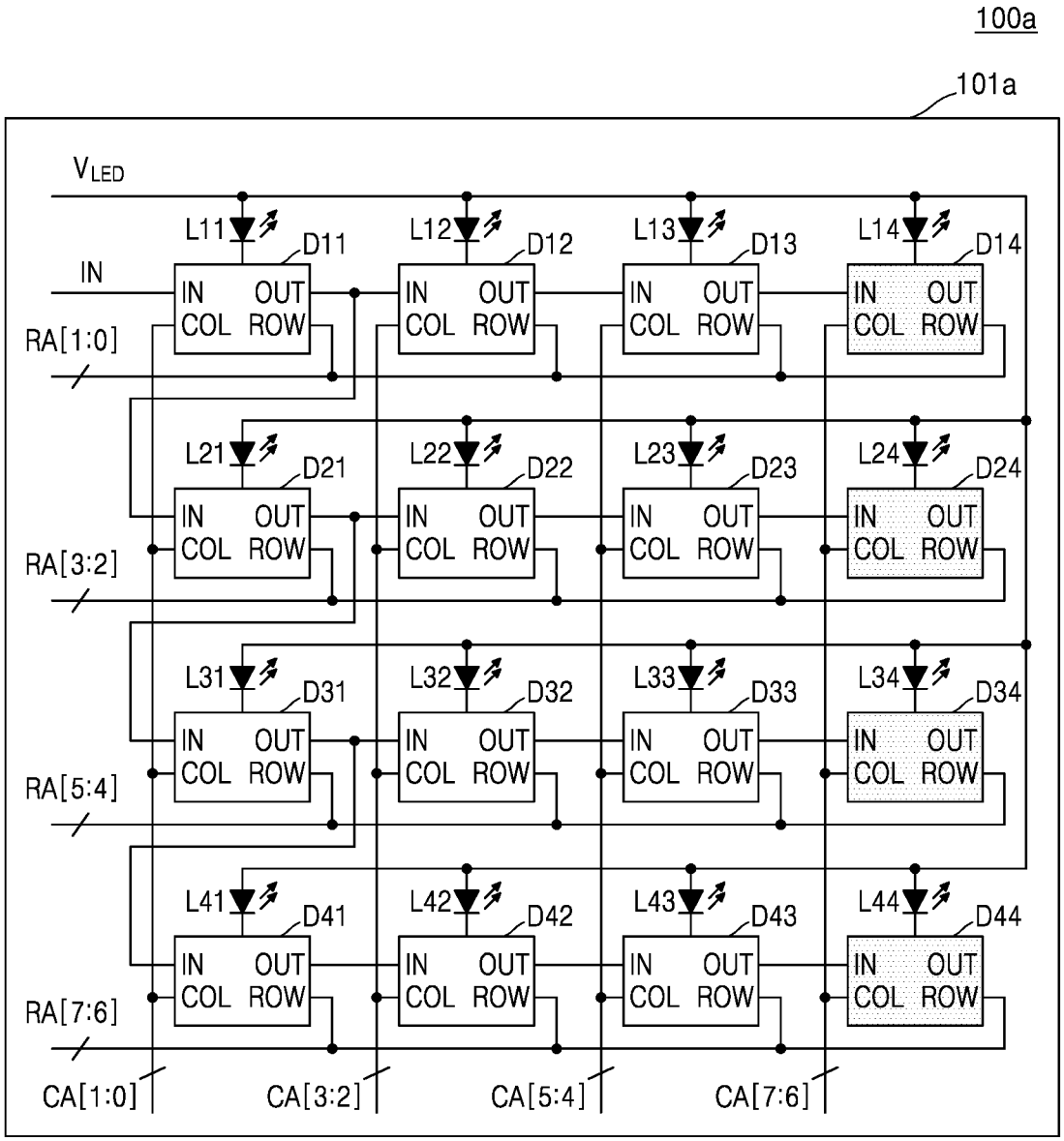
FIGS. 10A and 10B are diagrams of examples of light-emitting modules according to example embodiments.
Figure 10B:
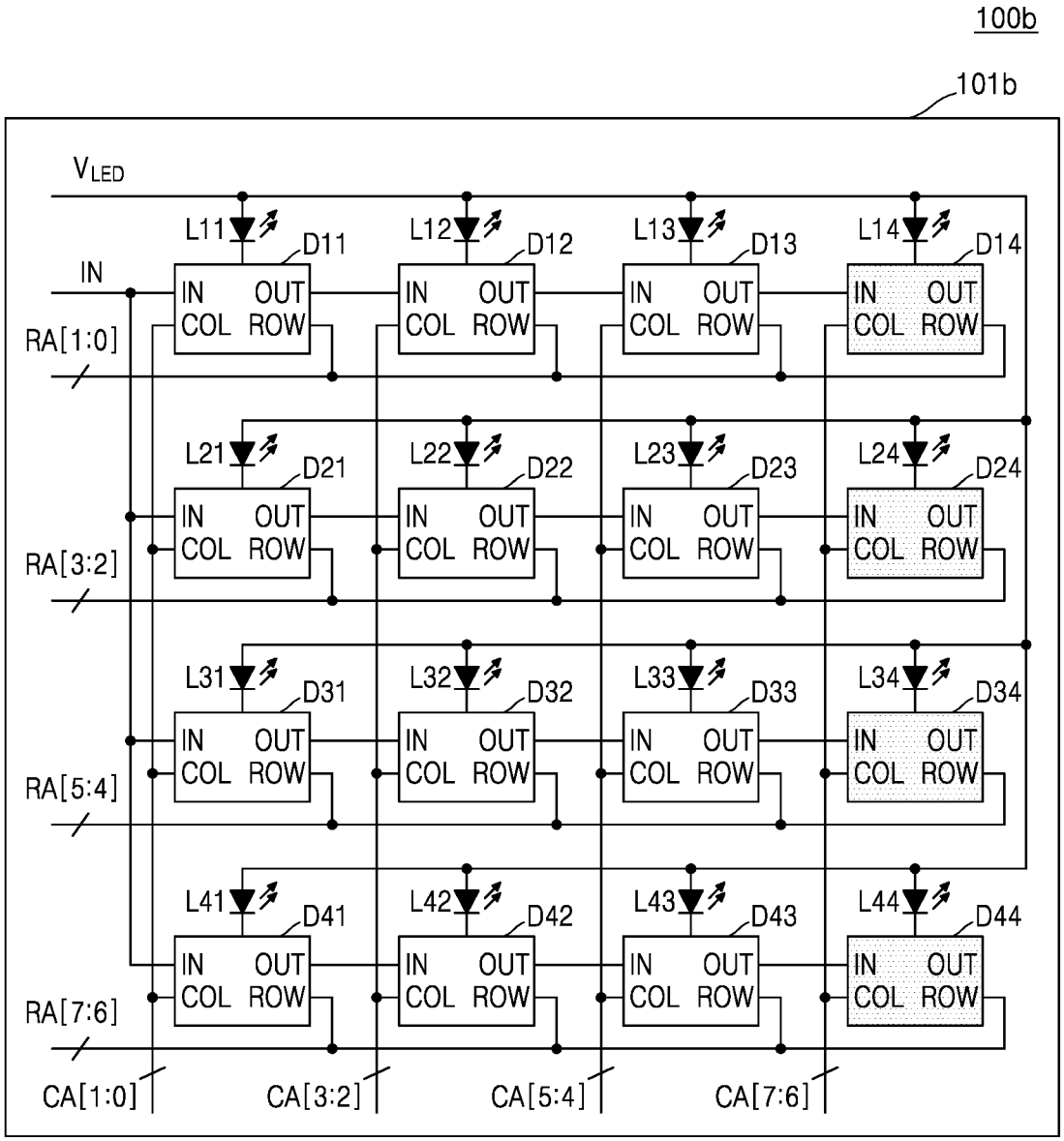

FIGS. 10A and 10B are diagrams of examples of light-emitting modules according to example embodiments. Specifically, FIGS. 10A and 10B respectively show light-emitting modules 100*a* and 100*b*, each including 16 LEDs arranged in the form of a 4×4 array and 16 LED drivers. In some embodiments, unlike shown in FIGS. 10A and 10B, the LEDs and the LED drivers may be arranged in a form different from the 4×4 array, and less than 16 LEDs and LED drivers or more than 16 LEDs and LED drivers may be included in the light-emitting module. Hereinafter, repeated descriptions in descriptions of FIGS. 10A and 10B will be omitted.

Referring to FIG. 10A, the light-emitting module 100*a* may include an LED array, an LED driver array, and a board 101*a*. The LED array may include four LEDs L11 to L14 in a first row, four LEDs L21 to L24 in a second row, four LEDs L31 to L34 in a third row, and four LEDs L41 to L44 in a fourth row. The LED driver array my include four LED drivers D11 to D14 in the first row, four LED drivers D21 to D24 in the second row, four LED drivers D31 to D34 in the third row, and four LED drivers D41 to D44 in the fourth row. The LED array and the LED driver array may be mounted on the board 101*a*, and the board 101*a* may include patterns for connecting the LEDs and/or the LED drivers to each other. In some embodiments, the board 101*a* may be a printed circuit board (PCB).

In some embodiments, the board 101*a* may include a plurality of patterns (herein, which may be referred to as a plurality of first patterns) connected to two adjacent LED drivers so that the LED drivers included in one row receive the input signal IN in a chain. For example, as shown in FIG. 10A, the board 101*a* may include a pattern connecting the LED drivers D11 and D12 so that an output signal of the LED driver D11 is provided to the LED driver D12 in the first row.

In some embodiments, the board 101*a* may include a plurality of patterns (herein, which may be referred to as a plurality of second patterns) respectively connected to a plurality of LED drivers so that a unique signal is applied to each of the plurality of LED drivers. In some embodiments, the board 101*a* may include at least one pattern providing at least one of a constant voltage, a constant current, and a constant resistance to an LED driver to provide a unique identifier to each of a plurality of LED drivers. For example, as shown in FIG. 10A, the board 101*a* may include patterns configured to provide a common signal RA[1:0] to the four LED drivers D11 to D14 included in the first row of the LED driver array. Also, the board 101*a* may include patterns configured to provide a common signal CA[1:0] to the four LED drivers D11 to D41 included in a first column of the LED driver array.

In some embodiments, the board 101*a* may include patterns corresponding to the first row of the LED driver array. The patterns may be applied by the ground potential GND to correspond to the common signal RA[1:0], for example, a logic "00". The board 101*a* may include patterns corresponding to the second row of the LED driver array, The patterns may be applied by the ground potential GND and the positive power supply voltage VDD to correspond to a common signal RA[3:2], for example, a logic "01". The board 101*a* may include patterns corresponding to the third row of the LED driver array, The patterns may be applied by the positive power supply voltage VDD and the ground potential GND to correspond to a common signal RA[5:4], for example, a logic "10". The board 101*a* may include patterns corresponding to the fourth row of the LED driver array. The patterns may be applied by the positive power supply voltage VDD to correspond to a common signal RA[7:6], for example, a logic "11".

In some embodiments, the board 101*a* may include patterns corresponding to the first column of the LED driver array. The patterns may be applied by the ground potential GND to correspond to the common signal CA[1:0], for example, a logic "00". The board 101*a* may include patterns corresponding to the second column of the LED driver array. The patterns may be applied by the ground potential GND and the positive power supply voltage VDD to correspond to a common signal CA[3:2], for example, a logic "01". The board 101*a* may include patterns corresponding to the third column of the LED driver array, The patterns may be applied by the positive power supply voltage VDD and the ground potential GND to correspond to a common signal CA[5:4], for example, a logic "10". The board 101*a* may include patterns corresponding to the fourth column of the LED driver array, The patterns may be applied by the positive power supply voltage VDD to correspond to a common signal CA[7:6], for example, a logic "11".

In some embodiments, the board 101*a* may include a plurality of patterns (herein, which may be referred to as a plurality of third patterns) connected to two adjacent LED drivers so that the LED drivers in one column among the columns of the LED driver array receive the input signal IN in a chain. For example, as shown in FIG. 10A, the board 101*a* may include a pattern connecting the LED drivers D11 and D21 so that an output signal of the LED driver D11 is provided to the LED driver D21 in the first column.

In some embodiments, each of the 16 LED drivers shown in FIG. 10A may receive an enable signal as described above with reference to FIG. 9. The board 101*a* may include at least one pattern (herein, which may be referred to as at least one fifth pattern) respectively connected to a plurality of end LED drivers so that a deactivated enable signal is applied to a end LED driver that finally receives the input signal IN in each row of the LED driver array. For example, the board 101*a* may include at least one pattern connected to (or one pattern commonly connected to) the four LED drivers D14 to D44 so that a deactivated enable signal (for example, a ground potential) is applied to the four LED drivers D14 to D44 included in the fourth column of the LED driver array. Also, the board 101*a* may include at least one pattern (herein, which may be referred to as at least one sixth pattern) respectively connected to LED drivers so that an activated enable signal is applied to the LED drivers except for the plurality of end LED drivers. For example, the board 101*a* may include at least one pattern connected to (or one pattern commonly connected to) 12 LED drivers so that an activated enable signal (for example, a potential power supply voltage) is applied to the 12 LED drivers included in the first to third columns of the LED driver array.

Referring to FIG. 10B, the light-emitting module 100*b* may include an LED array, an LED driver array, and a board 101*b*. The LED array may include four LEDs L11 to L14 in a first row, four LEDs L21 to L24 in a second row, four LEDs L31 to L34 in a third row, and four LEDs L41 to L44 in a fourth row. The LED driver array my include four LED drivers D11 to D14 in the first row, four LED drivers D21 to D24 in the second row, four LED drivers D31 to D34 in the third row, and four LED drivers D41 to D44 in the fourth row. The LED array and the LED driver array may be mounted on the board 101*b*, and the board 101*b* may include patterns for connecting the LEDs and/or the LED drivers to each other.

In some embodiments, the board 101*b* may include at least one pattern (herein, which may be referred to as at least one fourth pattern) commonly connecting LED drivers included in a column so that the LED drivers included in the column among the columns of the LED driver array commonly receive the input signal IN. For example, as shown in FIG. 10B, the board 101*b* may include a pattern commonly connected to the four LED drivers D11 to D41 so that the input signal IN is commonly provided to the four LED drivers D11 to D41 in the first column.

Figure 11:
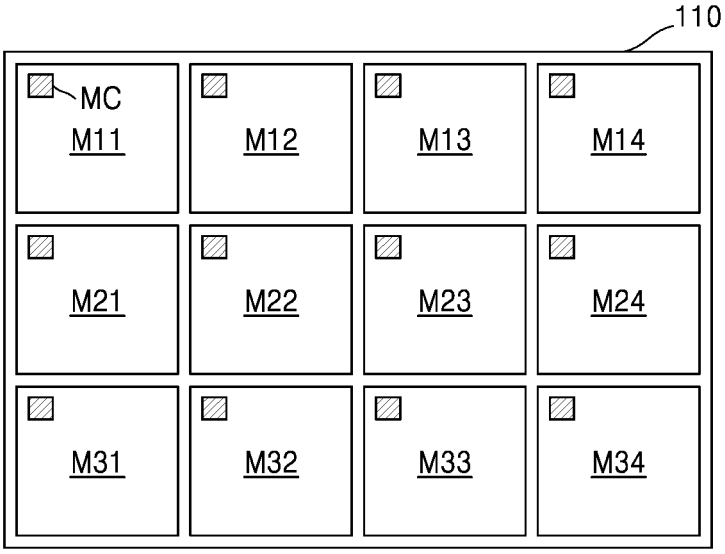
FIG. 11 is a diagram of a backlight unit according to an example embodiment.

FIG. 11 is a diagram of a BLU 110 according to an example embodiment. As described above with reference to FIG. 1, the BLU 110 may be included in a display device and may support a mini LED.

Referring to FIG. 11, the BLU 110 may include a plurality of light-emitting modules. When the area of a display panel is large, it may be limited to cover the entire display panel by using one light-emitting module. Accordingly, as shown in FIG. 11, identical light-emitting modules may be arranged in the form of an array in the BLU 110. For example, as shown in FIG. 11, the BLU 110 may include four light-emitting modules M11 to M14 in a first row of a light-emitting module array, four light-emitting modules M21 to M24 in a second row of the light-emitting module array, four light-emitting modules M31 to M34 in a third row of the light-emitting module array, and four light-emitting modules M41 to M44 in a fourth row of the light-emitting module array. In some embodiments, unlike shown in FIG. 11, the light-emitting modules may be arranged in a form different from a 3×4 array, and less than 12 light-emitting modules or more than 12 light-emitting modules may be included in the BLU 110.

In some embodiments, a light-emitting module may include a module controller. For example, as shown in FIG. 11, the light-emitting module M11 may include a module controller MC. The module controller MC may receive a signal from the outside of the light-emitting module M11, and may generate the input signal IN based on the received signal. As described above with reference to the drawings, the module controller MC may provide the input signal IN to some of LED drivers included in the light-emitting module M11, and the input signal IN may be transmitted to the remaining LED drivers in a chain.

According to an LED driver, a light-emitting module, and a display device according to an example embodiment, due to the limited length of a signal path, the influence of parasitic components may be reduced, thereby preventing malfunctions and delays in LED control.

Also, according to an LED driver, a light-emitting module, and a display device according to an example embodiment, random access to an LED based on an address may be possible, thereby reducing latency for LED control.

Also, according to an LED driver, a light-emitting module, and a display device according to an example embodiment, uniform LED drivers may be used, and overhead for addressing the LED drivers may be omitted, thereby improving the productivity of the LED driver, the light-emitting module, and the display device.

Effects that can be obtained in the example embodiments are not limited to the above-mentioned effects, and other effects not mentioned may be clearly derived and understood by those of ordinary skill in the art from the following descriptions. That is, unintended effects of carrying out the example embodiments may also be derived by those of ordinary skill in the art from the example embodiments.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A light-emitting module comprising:

a light-emitting diode (LED) array comprising a plurality of LEDs;

an LED driver array comprising a plurality of LED drivers configured to respectively generate a plurality of LED driving currents respectively corresponding to the plurality of LEDs based on an input signal; and a board on which the LED array and the LED driver array are mounted, wherein the board comprises:

a plurality of first patterns each connecting two adjacent LED drivers with each other among the plurality of LED drivers such that a first LED driver receives a first input signal from a second LED driver through at least one of the plurality of first patterns, the first LED driver and the second LED driver being adjacent to each other and included in a same row of the LED driver array; and a plurality of second patterns respectively connected to the plurality of LED drivers such that a unique signal is applied to each of the plurality of LED drivers, wherein the first LED driver comprises a repeater configured to generate a second input signal by amplifying the first input signal, and the second input signal is transmitted through at least one of the plurality of first patterns from the first LED driver to a third LED driver adjacent to the first LED driver in the same row of the LED driver array.

2. The light-emitting module of claim 1, wherein the plurality of second patterns comprises:

a second pattern configured to apply a first common signal to LED drivers included in each row of the LED driver array; and a second pattern configured to apply a second common signal to LED drivers included in each column of the LED driver array.

3. The light-emitting module of claim 1, wherein each of the plurality of second patterns is configured to be applied by at least one of a constant voltage, a constant current and a constant resistance.

4. The light-emitting module of claim 1, wherein the board further comprises a plurality of third patterns connected to two adjacent LED drivers of the plurality of LED drivers such that LED drivers included in a first column among columns of the LED driver array receive the input signal in a chain.

5. The light-emitting module of claim 1, wherein the board further comprises at least one fourth pattern commonly connected to LED drivers included in a first column such that the LED drivers included in the first column among columns of the LED driver array commonly receive the input signal.

6. A light-emitting module comprising:

a light-emitting diode (LED) array comprising a plurality of LEDs;

an LED driver array comprising a plurality of LED drivers configured to respectively generate a plurality of LED driving currents respectively corresponding to the plurality of LEDs based on an input signal; and a board on which the LED array and the LED driver array are mounted, wherein the board comprises:

a plurality of first patterns each connecting two adjacent LED drivers with each other among the plurality of LED drivers such that LED drivers included in each row of the LED driver array receive the input signal in a chain; and a plurality of second patterns respectively connected to the plurality of LED drivers such that a unique signal is applied to each of the plurality of LED drivers, wherein the board further comprises:

at least one fifth pattern connected to each of a plurality of end LED drivers such that a deactivated enable signal is applied to an end LED driver that finally receives the input signal in each row of the LED driver array; and at least one sixth pattern connected to each of other LED drivers except for the plurality of end LED drivers such that an activated enable signal is applied to the other LED drivers except for the end LED driver in each row of the LED driver array.

* * * * *